US011220953B2

(12) United States Patent
Findeisen et al.

(10) Patent No.: US 11,220,953 B2
(45) Date of Patent: Jan. 11, 2022

(54) COOLING FAN MODULE

(71) Applicant: Brose Fahrzeugteile SE & Co. Kommanditgesellschaft, Würzburg, Würzburg (DE)

(72) Inventors: Antje Findeisen, Oldenburg (DE); Tilman Schäfer, Edewecht (DE)

(73) Assignee: Brose Fahrzeugteile SE & Co. Kommanditgesellschaft, Würzburg, Würzburg (DE)

( * ) Notice: Subject to any disclaimer, the term of this patent is extended or adjusted under 35 U.S.C. 154(b) by 0 days.

(21) Appl. No.: 16/632,452

(22) PCT Filed: Jul. 19, 2018

(86) PCT No.: PCT/EP2018/069579

§ 371 (c)(1),
(2) Date: Jan. 20, 2020

(87) PCT Pub. No.: WO2019/016295

PCT Pub. Date: Jan. 24, 2019

(65) Prior Publication Data

US 2021/0148277 A1 May 20, 2021

(30) Foreign Application Priority Data

Jul. 20, 2017 (DE) ..... 10 2017 116 352.2

(51) Int. Cl.

| | |
|---|---|
| ***F01P 11/10*** | (2006.01) |
| ***F01P 5/06*** | (2006.01) |
| ***F04D 25/08*** | (2006.01) |
| *F04D 19/00* | (2006.01) |
| *F04D 29/16* | (2006.01) |

(52) U.S. Cl.
CPC ..... *F01P 11/10* (2013.01); *F04D 25/08* (2013.01); *F01P 5/06* (2013.01); *F04D 19/002* (2013.01); *F04D 29/164* (2013.01)

(58) Field of Classification Search
CPC ..... F01P 11/10; F01P 5/06; F01P 3/02
See application file for complete search history.

(56) References Cited

U.S. PATENT DOCUMENTS

| | | | | |
|---|---|---|---|---|
| 4,662,822 | A | 5/1987 | Foeldesi et al. | |
| 6,364,004 | B1 * | 4/2002 | Ehrmann | F04D 25/0606 123/41.31 |

(Continued)

FOREIGN PATENT DOCUMENTS

| | | | |
|---|---|---|---|
| DE | 3503220 | C1 | 7/1986 |
| DE | 112016003244 | T5 | 4/2018 |

(Continued)

*Primary Examiner* — Long T Tran
(74) *Attorney, Agent, or Firm* — Brooks Kushman P.C.

(57) ABSTRACT

A cooler fan module, having: a fan frame, a fan wheel recess formed in the fan frame, wherein the fan wheel recess is bounded by a frame ring, a motor mount, which is arranged within the fan wheel recess and is mechanically connected to the fan frame by means of struts, a motor, more particularly an electric motor, which is held at least partially in the motor mount, and a fan wheel, which is arranged in the fan wheel recess and is rotationally driven by the motor, wherein the cooler fan module further has a separately formed, annular structure element, which is arranged on the frame ring.

19 Claims, 5 Drawing Sheets

(56) References Cited

U.S. PATENT DOCUMENTS

| | | | | |
|---|---|---|---|---|
| 8,251,674 | B1 * | 8/2012 | Pairaktaridis | H02K 9/06 417/354 |
| 2007/0280827 | A1 | 12/2007 | Stevens et al. | |
| 2009/0151911 | A1 * | 6/2009 | De Filippis | F04D 29/384 165/122 |
| 2012/0321474 | A1 * | 12/2012 | Stevens | F04D 29/545 416/190 |
| 2014/0105746 | A1 * | 4/2014 | Findeisen | F04D 29/325 416/182 |
| 2015/0176596 | A1 * | 6/2015 | Gossling | H02K 5/00 417/423.1 |

FOREIGN PATENT DOCUMENTS

| | | | |
|---|---|---|---|
| JP | S61175219 | A | 8/1986 |
| JP | 2005147018 | A | 6/2005 |
| JP | 2007040110 | A | 2/2007 |
| KR | 19990076707 | A | 10/1999 |
| WO | 2009062292 | A1 | 5/2009 |

* cited by examiner

COOLING FAN MODULE

CROSS-REFERENCE TO RELATED APPLICATIONS

This application is the U.S. National Phase of PCT Application No. PCT/EP2018/069579 filed on Jul. 19, 2018, which claims priority to German Patent Application No. 10 2017 116 352.2, filed on Jul. 20, 2017, the disclosures of which are hereby incorporated in their entirety by reference herein.

TECHNICAL FIELD

The present disclosure relates to a cooling fan module, in particular an electrically operated cooling fan module for use in motor vehicles.

BACKGROUND

The cooling system of an internal combustion engine, in particular of a motor vehicle, discharges primarily heat that is released from walls of combustion chambers and cylinders, because the combustion process does not take place in an ideal manner. Since excessively high temperatures would damage the engine (separation of the lubricating film, burning of the valves etc.), the internal combustion engine must be actively cooled.

Modern internal combustion engines, in particular four-stroke engines in motor vehicles, are, aside from a few exceptions, liquid-cooled, wherein a mixture of water, anti-freeze agent and corrosion prevention agent is generally used as cooling liquid.

The cooling liquid is pumped via hoses, pipes and/or channels through the engine (cylinder head and engine block) and possibly through thermally highly loaded attachment parts of the engine, such as exhaust-gas turbocharger, generator or exhaust-gas recirculation cooling. Here, the cooling liquid absorbs heat energy and discharges it from the above-stated components. The heated cooling liquid flows onward to a cooling. Said cooling in the past often composed of brass, nowadays normally composed of aluminum is normally installed at the front of the motor vehicle, where an air stream absorbs heat energy from the coolant and thus cools the latter before it flows back to the engine, whereby the coolant circuit is closed.

In order to drive the air through the cooling, a cooling fan module is provided in front (that is to say upstream) of the cooling or behind (that is to say downstream of) the cooling as viewed in a flow direction, which cooling fan module may be driven mechanically by means of a belt drive or electrically by means of an electric motor. The following statements relate to an electrically driven cooling fan module.

A cooling fan module is classically composed of a fan shroud, which has a fan wheel recess. In the fan wheel recess there is arranged a motor holder which is mechanically connected to the fan shroud by means of struts. The struts may be arranged, in terms of the air volume flow, on the downstream or upstream side of the fan shroud. A motor, in particular an electric motor, is held in the motor holder. On an output shaft of the electric motor, there is arranged a fan wheel which driven by the electric motor rotates in the fan wheel recess. Owing to the size of the fan wheel recess, which in some cases covers 70% of the area of the fan shroud, challenges arise in providing the required stability of the overall system, in particular without significantly impairing the air conveyance characteristics.

SUMMARY

One or more objects of the present disclosure may be to provide cooling fan module which is advantageous in particular with regard to its stiffness and/or its air conveyance characteristics and/or with regard to further provided functions.

According to one or embodiments, one or more objects may be achieved by a cooling fan module, having a fan shroud, a fan wheel recess which is formed in the fan shroud, wherein the fan wheel recess is delimited by a shroud ring, a motor holder which is arranged within the fan wheel recess and which is mechanically connected to the fan shroud by means of struts, a motor, such as an electric motor, which is at least partially held in the motor holder, and a fan wheel which is arranged in the fan wheel recess and which is driven in rotation by the motor. The cooling fan module may include a separately formed, ring-shaped structural element which is arranged on the shroud ring.

In one embodiment of the present disclosure, the cooling fan module may provide expedient stiffness. This may be advantageous because the fan shroud is reinforced, such as in the region of the fan wheel recess, which, in previously known solutions, owing to the configuration thereof as an at least substantially material-free aperture, commonly led to a considerable reduction in the overall stiffness of the cooling fan module.

In another embodiment, the fan shroud may be formed of one or more plastic material. As one example, the fan shroud may be formed from a plastic material, and/or the fan shroud is produced by means of an injection molding process. In the case of plastics components, such as in the case of injection-molded plastic components, it is necessary to avoid material accumulations or thickenings, because these lead to an increased likelihood of cavities, that is to say hollow spaces within the plastic material, which arise owing to the plastic material contracting during the cooling process and, in so doing, give rise to a sometimes considerable reduction in the stiffness of the cooling fan module, such as of the fan shroud. In the above-described embodiment, the shroud ring that delimits the fan wheel recess may have a relatively thin-walled design, which leads to a reduction in the likelihood of cavities. The deliberately reduced stiffness of the fan shroud owing to the reduced wall thickness is at least compensated by means of the separately formed ring-shaped structural element that is arranged on the shroud ring.

In one embodiment of the present disclosure, the solutions presented above may be advantageous because the separate formation of the ring-shaped structural element can lead to advantageous assembly processes. In accordance with an assembly process, the separately formed ring-shaped structural element is arranged on the shroud ring after the fan wheel has been arranged in the fan wheel recess. In a known manner, a cooling fan module has a gap between a radially outer edge of the fan wheel and the shroud ring, which gap has an adverse effect on the volume of air conveyed per unit of time. For this reason, it is a known measure to configure said gap to be as narrow as possible in order to minimize the gap flow, which will be described in more detail further below. This approach generally leads to increased requirements in terms of the precision of the assembly of the fan wheel within the fan wheel recess owing to the high requirements in terms of the accuracy of the positioning of fan shroud and fan wheel relative to one another. In one embodiment of the present disclosure, the separately formed ring-shaped structural element according to the disclosure is advantageous because, in this way, it is possible to tolerate a larger gap, which facilitates the assembly process, between fan wheel and fan wheel recess, which gap is subsequently reduced to a desired dimension by means of the arrangement of the separately formed ring-shaped structural element after the installation of the fan wheel in the fan wheel recess.

A "cooling fan module" within the meaning of the present disclosure is in particular an assembly which, as viewed in a flow direction, is arranged upstream or downstream of a cooling of a vehicle and which is provided and configured, for generating an air volume flow which passes through the cooling or around the cooling, wherein the air volume flow absorbs thermal energy from the cooling.

A "fan shroud" within the meaning of the present disclosure may be a frame in which the fan wheel is held and which itself is in turn may be arranged, such as fastened, at or in the vicinity of a cooling. A fan shroud within the meaning of the present disclosure may include a plastic material, such as a plastic compound, the fan shroud in particular being formed therefrom. Additionally and/or alternatively, the fan shroud may be formed of a metal material, for example iron, steel, aluminum, magnesium or the like. In one embodiment, a fan shroud may also have more than one fan wheel recess, one motor holder, one motor and one fan wheel, and in particular, the present disclosure is suitable for use in cooling fan modules with two or more fan wheels. In one embodiment, the fan shroud may include one or more closable openings, formed by one or more flaps. This may be advantageous to realize further air guidance characteristics.

A "fan wheel recess" within the meaning of the present disclosure may be a material cutout within the fan shroud. In one embodiment of the present disclosure, struts extend in the fan wheel recess, which struts mechanically, in particular also electrically and/or electronically, connect a motor holder, which is likewise arranged in the fan wheel recess, to the fan shroud. According to the present disclosure, the fan wheel recess is delimited by a shroud ring.

A "shroud ring" within the meaning of the present disclosure, may delimit the fan wheel recess in a plane perpendicular to the axis of rotation of the fan wheel, the plane may be at least substantially identical to the direction of extent of the fan shroud. The shroud ring may either be formed by an edge of the fan wheel recess and/or have a cylinder surface which extends in an axial direction and which is may be formed as a single piece with the fan shroud.

A "motor holder" within the meaning of the present disclosure may be a device for mechanically fastening the motor to the fan shroud, such as to provide torque that counteracts the fan wheel. In one embodiment, the motor holder may have a ring-shaped structure in which the motor is held. This is advantageous in particular because, in this way, an advantageous cooling air flow is not impaired by the motor.

"Struts" within the meaning of the present disclosure are in particular beam-like or sickle-like structures which provide a mechanical connection between the motor holder and the fan shroud. By way of example, the struts may have a droplet-shaped cross section in order to realize advantageous aerodynamic and/or acoustic effects.

A "motor" within the meaning of the present disclosure is in particular a machine which performs mechanical work by converting one energy form, for example thermal/chemical or electrical energy, into kinetic energy, in particular a torque. This is advantageous in particular because, in this way, the fan shroud can be operated at least substantially autonomously aside from the feed of energy, that is to say without being supplied with kinetic energy from an external source, for example via a V-belt or toothed belt.

An "electric motor" within the meaning of the present disclosure is an electromechanical converter (electric machine) which converts electrical power into mechanical power, in particular into a torque. Within the meaning of the present disclosure, the expression "electric motor" comprises, but is not limited to, DC motors, AC motors and three-phase motors, and brush-type and brushless electric motors, and internal-rotor and external-rotor motors. This is advantageous in particular because electrical energy constitutes an energy form which is easy to transmit in relation to mechanical or chemical energy and with which the required torque for driving the fan wheel is provided.

A "fan wheel" within the meaning of the present disclosure is in particular a rotationally symmetrical component which a hub, in particular a hub pot structure, which connects the fan wheel to the motor, in particular via a shaft which projects out of said motor, in such a way that the torque that is generated by the motor is at least substantially entirely transmitted to the fan wheel. Furthermore, the fan wheel has a multiplicity of vanes which are provided, in particular configured, for generating an air volume flow as soon as the fan wheel is set in rotational motion. The vanes are in this case may be inclined relative to the axis of rotation in an angle range from −90° to +90°. As one example, the tips, situated at the outside in an axial direction, of the vanes are connected to one another by means of a vane wheel outer ring. This may be advantageous because, in this way, increased mechanical strength of the fan wheel may be achieved, and a defined, at least substantially constant, gap is provided between shroud ring and fan wheel outer ring, which in turn leads to advantageous aerodynamic and/or acoustic effects.

A "separately formed ring-shaped structural element" within the meaning of the present disclosure may be a component produced independently of the fan shroud and that may be first arranged on the fan shroud, such as on the shroud ring, during the course of the assembly process. In one embodiment, a shroud ring within the meaning of the present disclosure may be formed of a material from a group comprising thermoset, thermoplastic, thermoplastic compound, iron, steel, aluminum, magnesium or the like, or a mixture thereof. As one example, the separately formed ring-shaped structural element may be at least substantially, or entirely, formed from a material from the above-stated group. This may be advantageous in particular because, in this way, it is possible for a material that differs from the fan shroud to be selected for the separately formed ring-shaped structural element, thus allowing additional freedom in the mechanical and acoustic configuration of the cooling fan module.

In one embodiment of the present disclosure, the shroud ring may include a cylindrical lateral surface. A normal vector of the cylindrical lateral surface oriented at least substantially perpendicular to the axis of rotation of the fan wheel. This may be advantageous in particular because, in this way, an air-guiding element may be provided that may permit guidance of the air flow in the region of the fan wheel, more specifically in the region of the greatest compressions and turbulence, and thus advantageously permits targeted air flow guidance in the direction of the cooling or of the air outflow path with reduced losses.

In one or more embodiments of the present disclosure, the shroud ring may be formed as a single piece with the fan shroud. This may be advantageous because it may be possible to realize an economically advantageous manufacturing process.

In one embodiment of the present disclosure, the shroud ring extends in a downstream direction away from the fan shroud as far as a free end. This is advantageous in particular because, in this way, material not required for mechanical reasons can be saved, because the air volume flow generally has low kinetic energy, such that extensive support structures can be omitted.

In one embodiment of the present disclosure, the ring-shaped structural element has a U-shaped cross-sectional geometry in a radial cross section. This is advantageous in particular because, in this way, a stable structure is created which is provided, in particular configured, for improving the mechanical stiffness of the cooling fan module, in particular in the region of the fan wheel recess.

In one embodiment of the present disclosure, the free end of the shroud ring is engaged around in a radial and/or axial direction by the ring-shaped structural element and/or is at least partially received in the U-shaped cross-sectional geometry of the ring-shaped structural element. This is advantageous in particular because, in this way, the gap that exists between fan wheel and shroud ring can be adapted, in accordance with the aerodynamic and/or acoustic and/or mechanical characteristics, to the respective usage situation. In this way, it is furthermore particularly advantageously possible to realize the retroactive, that is to say after the assembly of the fan wheel on the fan shroud, reduction of the air gap between the shroud ring and the fan wheel outer ring, as already discussed above. In other words: the ring-shaped structural element is, in one embodiment, at least partially placed with the open side over the shroud ring, wherein the shroud ring is at least partially, in particular at least substantially entirely, in particular entirely, received in the at least substantially gap-like recess of the ring-shaped structural element.

In a further embodiment of the present disclosure, the struts are arranged on an upstream side of the fan shroud. This is of importance because the arrangement of the struts on the upstream or downstream side of the fan shroud, in other words on the suction side or the pressure side of the fan wheel, leads to significantly different flow characteristics, which must be taken into consideration in the design process. In one or more embodiments of the present disclosure, the separately formed ring-shaped structural element is arranged on that side of the fan shroud which is situated opposite the struts. This is advantageous in particular because, in this way, the connecting points between fan shroud and struts do not have to be taken into consideration, but rather a body which is at least substantially rotationally symmetrical in the region of the shroud ring may be used as a basis. In a further embodiment of the present disclosure, the ring-shaped structural element has at least one fastening means, such as a fastening flange, that may be configured for holding the ring-shaped structural element on the fan shroud. This is advantageous in particular because, in this way, a simple means can be provided for mechanically fastening the separately formed ring-shaped structural element to the fan shroud, in particular after the assembly of the fan wheel on the fan shroud. For the fastening of the separately formed ring-shaped structural element to the fan shroud, use may be made in particular of screws, clips, rivets or the like. It is furthermore possible for the separately formed ring-shaped structural element to be fastened to the fan shroud by means of an adhesive bonding or welding process.

In a further embodiment of the present disclosure, the ring-shaped structural element has, for example rib-like, stiffening means which extend, for example in a radial and/or axial direction, on a surface, situated opposite the shroud ring, of the ring-shaped structural element. This may be advantageous for example because, in this way, the mechanical characteristics, for example the stiffness, of the separately formed ring-shaped structural element can be further increased, which leads to an increase in the stiffness of the cooling fan module. In other words: in one embodiment of the separately formed ring-shaped structural element, the stiffening means are material thickenings running in an encircling manner in a radial direction on the outer side of the separately formed ring-shaped structural element.

In one embodiment of the present disclosure, a gap is formed in a radial direction between the fan wheel and the shroud ring, wherein the ring-shaped structural element is arranged at least partially within said gap. For the advantages of this embodiment, reference is made to the above explanations relating to the other embodiments.

In a further embodiment of the present disclosure, the ring-shaped structural element has a gap cross section reduction portion which may be for example, formed as a single piece with the ring-shaped structural element and which extends, in a radial cross section, in the direction of the fan wheel, for example, in the direction of an outer ring of the fan wheel, and which is inclined at an angle $\alpha$ relative to the adjoining portion of the ring-shaped structural element, wherein the angle $\alpha$ is spanned in a radial plane in which the axis of rotation also extends, and amounts to between 30° and 150°, for example, between 60° and 120°, for example, between 75° and 105°, or for example, at least substantially 90°. This may be advantageous in particular because, in this way, a further means is provided for adapting the gap geometry, in particular the gap cross section, to the specific conditions of the usage situation, in order, in particular by means of the angle $\alpha$, to provide an additional air-guiding function. By means of the design of the structural element in accordance with this embodiment, it is possible to omit a cross-sectional thickening over the entire limb of the U-shaped profile, which in turn leads to a simplified production method and reduced material costs owing to the reduced risk of cavities.

In one embodiment of the present disclosure, the ring-shaped structural element may include a holding device configured for guiding, for example, holding, a hose-like and/or tubular structure, and/or which delimits the hose-like and/or tubular structure in at least one degree of freedom, in particular two, in particular three, in particular four, degrees of freedom.

A "degree of freedom" within the meaning of the present disclosure describes any of the independent movement capabilities of a system. In this context, a rigid body without constraints has three translational degrees of freedom and three rotational degrees of freedom.

This is advantageous in particular because, in this way, by means of the ring-shaped structural element, a hitherto unknown additional function can be provided by virtue of the fact that hose-like and/or tubular structures can be guided, in particular held, in a defined manner, which eliminates the need for additional, separate hose-like and/or pipe-holding structures. This in turn leads to a reduction in the parts required, in the assembly effort and thus ultimately in the production costs. Depending on the design of the holding device, it is possible for the hose-like and/or tubular structure to be delimited in one or more degrees of freedom. This is advantageous in particular because, in this way, it is for example possible for one degree of freedom to be intentionally left free, for example in order to allow follow-up movements of a hose-like structure in the event of vibrations, which in turn reduces the mechanical loading of the structure and ultimately increases the service life of the overall system.

In one embodiment of the present disclosure, the holding device has a separate blocking element which in particular has metal and which delimits the hose-like and/or tubular structure in at least one further degree of freedom, in particular by at least substantially completely surrounding the hose-like and/or tubular structure in a cross-sectional direction aside from an insertion opening. This is advantageous in particular because an extensive fixing of the hose-like and/or tubular structure can be realized in this way. The separate blocking element is particularly advantageous for this purpose in order to ultimately provide the blocking action, for example in the form of locking, and/or provide the required flexibility of the holding device that is required for moving the hose-like and/or tubular structure through the insertion opening during the course of the assembly process, which insertion opening in particular widens during the course of the insertion owing to an elastic deformation.

BRIEF DESCRIPTION OF THE DRAWINGS

Further advantageous refinements of the present invention will emerge from the subclaims and the following description of preferred embodiments. In this regard, the figures show, partially in schematic form:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
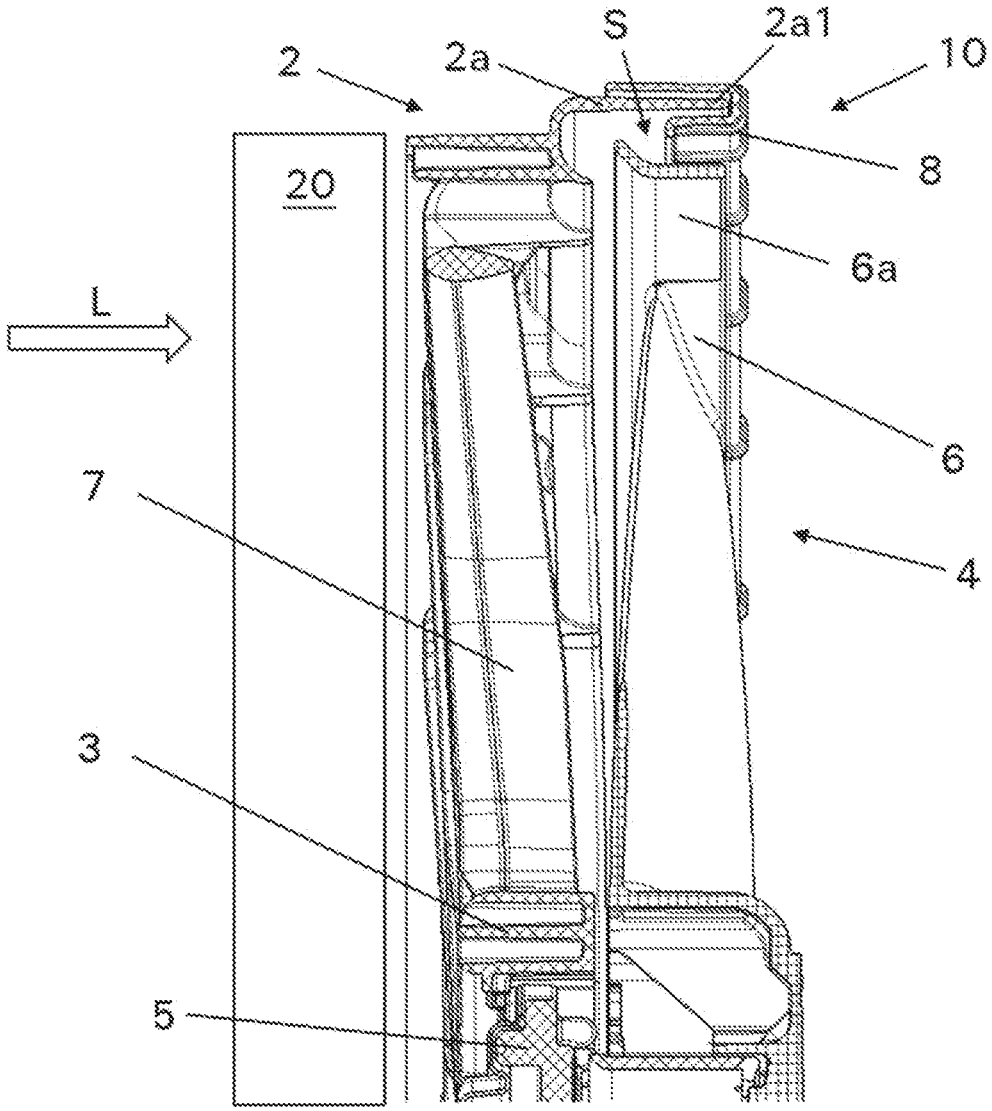
FIG. 1 a sectional view of a cooling fan module according to an embodiment of the present invention, wherein the axis of rotation lies in the section plane of the illustration.

FIG. 1 shows a sectional view of a cooling fan module 10 according to an embodiment of the present invention, wherein the axis of rotation lies in the section plane of the illustration.

In the illustrated embodiment, the cooling fan module 10 is arranged in the vicinity of a cooling 20, in particular directly at a cooling 20. The air flow direction L indicated by an arrow shows that the cooling fan module 10 is arranged on the downstream side of the cooling 20. The cooling fan module 10 in the illustrated embodiment has: a fan shroud 2, a fan wheel recess 4 which is formed in the fan shroud 2, wherein the fan wheel recess 4 is delimited by a shroud ring 2*a*, a motor holder 3 which is arranged within the fan wheel recess 4 and which is mechanically connected to the fan shroud 2 by means of struts 7, a motor 5, in particular electric motor 5, which is at least partially held in the motor holder 3, and a fan wheel 6 which is arranged in the fan wheel recess 4 and which is driven in rotation by the motor 5, wherein the cooling fan module furthermore has a separately formed, ring-shaped structural element 8 which is arranged on the shroud ring 2*a*.

In other words: the fan wheel 6 is inserted in the fan wheel recess 4 of the fan shroud 2 of the downstream cooling fan module 10. Said fan wheel is electrically driven by means of the electric motor 5, which is fastened by means of the struts 7 and the motor holder 3 to the shroud. The separately formed ring-shaped structural element 8 is mounted onto the fan shroud 2.

The shroud ring 2*a* has a cylindrical lateral surface, wherein a normal vector of the cylindrical lateral surface is oriented at least substantially perpendicular to an axis of rotation of the fan wheel 6. In the illustrated embodiment, the shroud ring 2*a* is formed as a single piece with the fan shroud 2. The shroud ring 2*a* extends in a downstream direction away from the fan shroud 2 as far as a free end 2*a*1. The ring-shaped structural element 8 has a U-shaped cross-sectional geometry 8*a* in a radial cross section (not shown in FIG. 1). The free end 2*a*1 of the shroud ring 2*a* is engaged around in a radial direction by the ring-shaped structural element 8 and is at least partially received in the U-shaped cross-sectional geometry 8*a* of the ring-shaped structural element 8.

Correspondingly to the embodiment illustrated in FIG. 1, the struts 7 are arranged on a downstream side of the fan shroud 2.

Figure 2B:
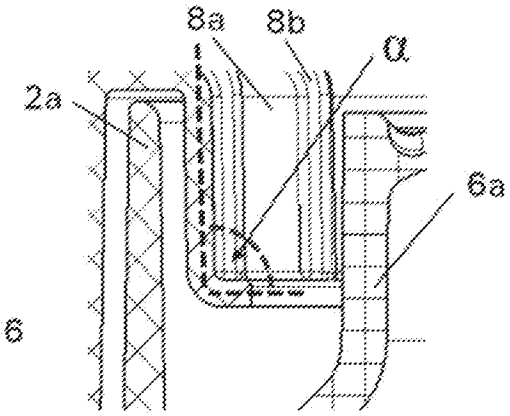
FIG. 2*b* an enlarged detail of the illustration in FIG. 2 in the region of the gap between shroud ring and fan wheel outer ring.
Figure 2A:
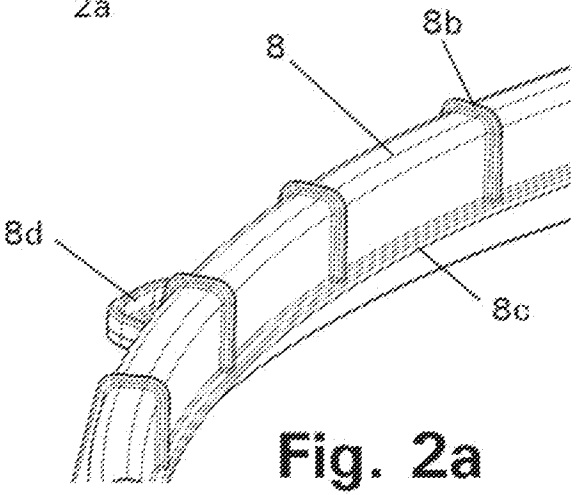
FIG. 2*a* a three-dimensional illustration of a detail of the ring-shaped structural element.
Figure 2:
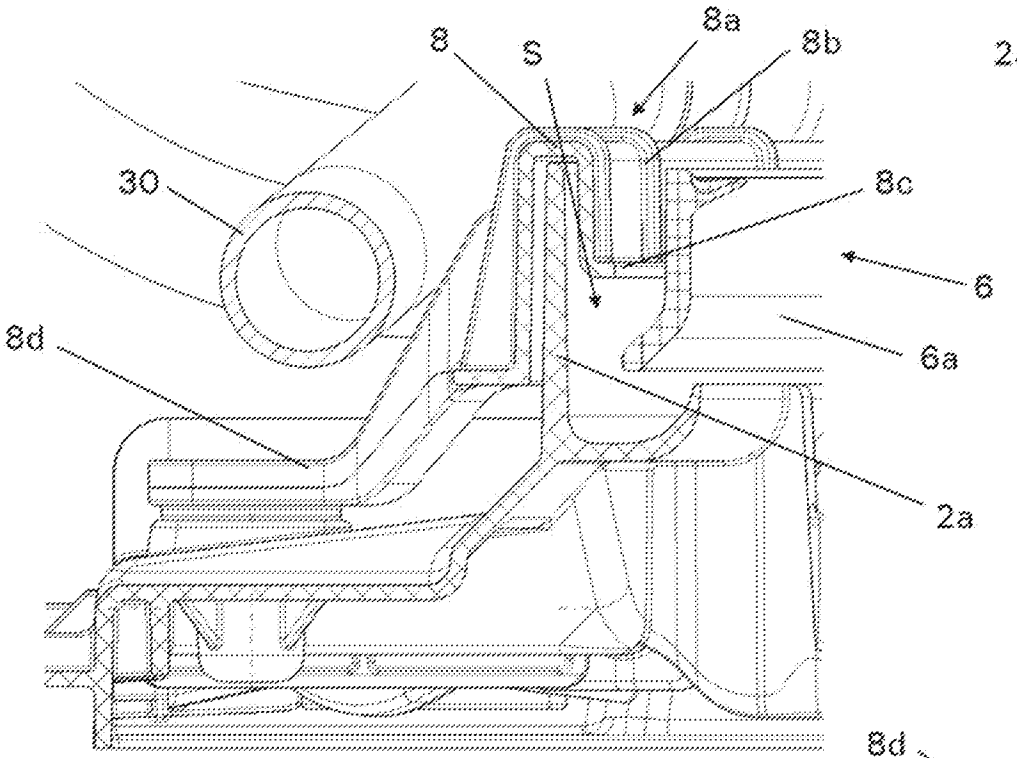
FIG. 2 an enlarged sectional view of the cooling fan module from FIG. 1 in a further sectional illustration.

FIG. 2 shows an enlarged sectional view of the cooling fan module from FIG. 1 in a further sectional illustration, FIG. 2*a* shows a three-dimensional illustration of a detail of the ring-shaped structural element 8, and FIG. 2*b* shows an enlarged detail of the illustration in FIG. 2 in the region of the gap between shroud ring 2*a* and fan wheel outer ring 6*a*.

The embodiments of the present invention illustrated in FIGS. 2, 2*a* and 2*b* show in particular the individual portions of the ring-shaped structural element 8. Aside from the U-shaped cross-sectional geometry 8*a*, the ring-shaped structural element 8 has stiffening means, in particular ribs, 8*b*, a gap cross section reduction portion 8*c*, and a fastening means, in particular a fastening flange, 8*d*.

Also visible is a hose-like and/or tubular structure 30 which is led past the fan wheel 6, in particular the fan wheel outer ring 6*a*, in the region of the ring-shaped structural element. Between the shroud ring 2*a* and the fan wheel 6, which is delimited by an outer ring 6*a*, there is formed a gap S which is required to permit a rotation of the fan wheel 6 within the fan wheel recess 4 (see FIG. 1). The fastening means, in particular the fastening flange, 8*c* is provided, in particular configured, for holding the ring-shaped structural element 8 on the fan shroud 2. Said ring-shaped structural element may be connected by one or more screws, or riveted, welded, adhesively bonded or mechanically fixed in some other way. The rib-like, stiffening means 8*b* may extend, for example, in a radial and/or axial direction, on a surface, situated opposite the shroud ring 2*a*, of the ring-shaped structural element 8. The ring-shaped structural element 8 is arranged at least partially within the gap S. Furthermore, the ring-shaped structural element 8 has the gap cross section reduction portion 8*d*, mentioned in the introduction, which is in particular formed as a single piece with the ring-shaped structural element 8 and which extends, in a radial cross section, in the direction of the fan wheel 6, in particular in the direction of an outer ring of the fan wheel 6, and which is inclined at an angle $\alpha$ relative to the adjoining portion of the ring-shaped structural element 8, wherein the angle $\alpha$ is spanned in a radial plane in which the axis of rotation also extends and amounts to at least substantially 90° in the present case.

Figure 3:
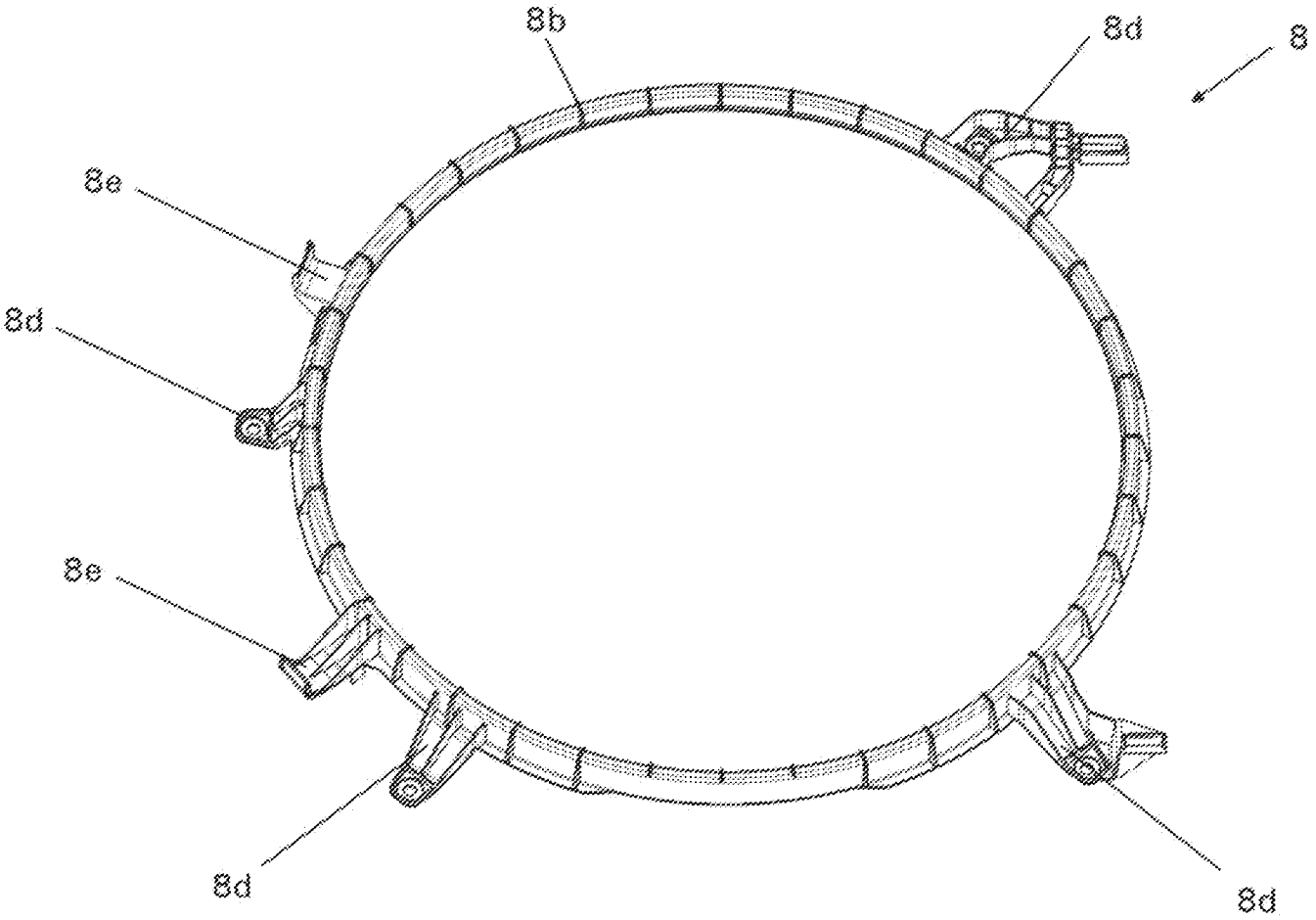
FIG. 3 a three-dimensional illustration of a ring-shaped structural element according to an embodiment of the present invention.

FIG. 3 shows a three-dimensional illustration of a ring-shaped structural element 8 according to an embodiment of the present invention.

The embodiment illustrated in FIG. 3 has a total of four fastening flanges 8*d* and two holding devices 8*e*. The holding devices 8*e* may either serve for guiding one and the same hose-like and/or tubular structure or else may guide two different hose-like and/or tubular structures. In the embodiment illustrated, the hose-like and/or tubular structures (not illustrated) lie in a U-shaped receptacle of the holding device 8*e* and are hereby constrained in four degrees of freedom.

As can likewise be seen from FIG. 3, it is possible for differently designed fastening means, in particular fastening flanges, 8*d* to be provided for fastening the ring-shaped structural element 8 to the fan shroud 2. Here, it is possible to use either in each case the same joining method, such as a screw connection, or a different one of the joining methods described above, or a mixture thereof.

Figure 4:
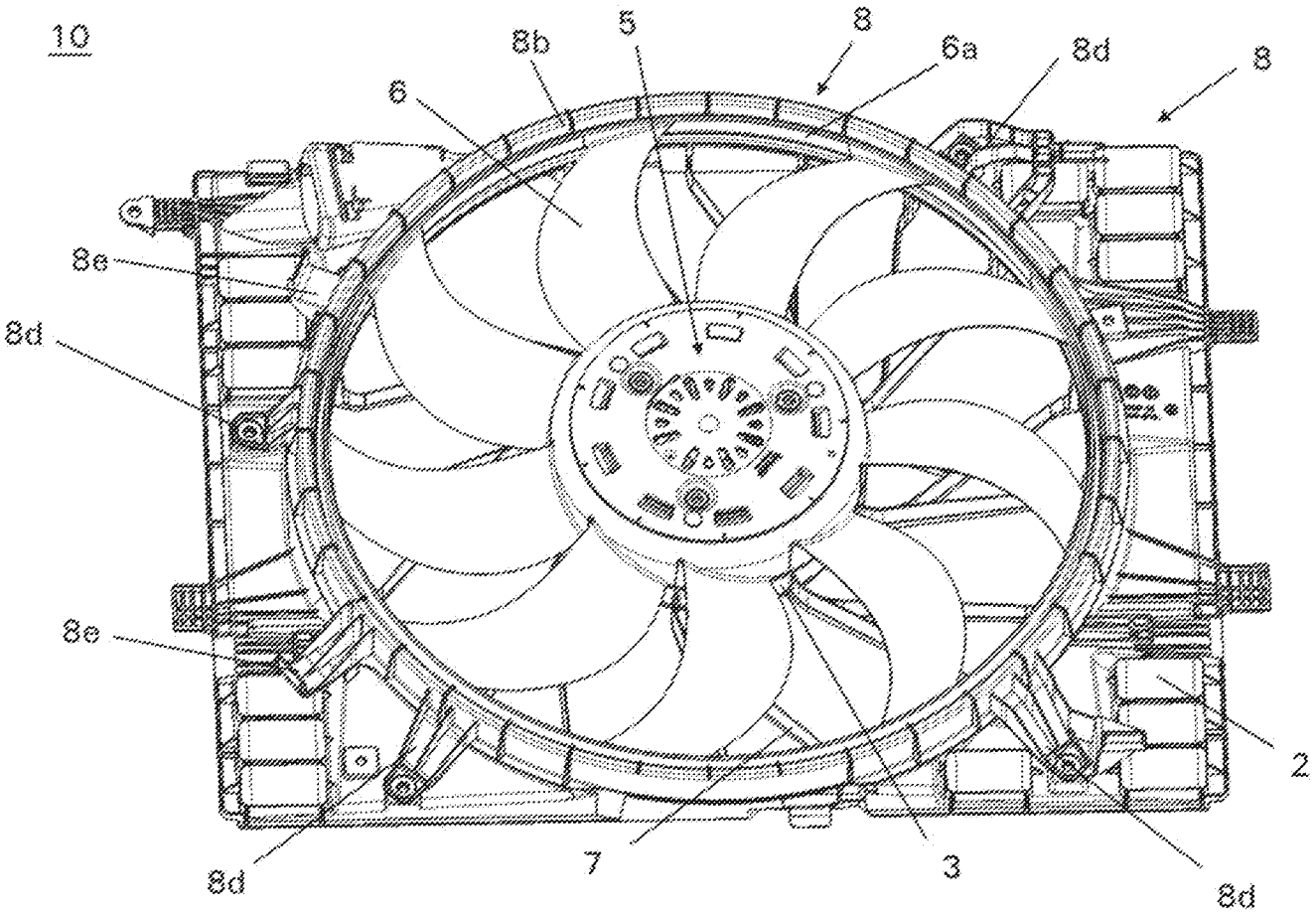
FIG. 4 a cooling fan module according to an embodiment of the present invention in a three-dimensional illustration.

FIG. 4 shows a cooling fan module according to an embodiment of the present invention in a three-dimensional illustration, wherein, here, the ring-shaped structural element 8 of FIG. 3 is arranged on a fan shroud 2 according to an embodiment of the present invention, wherein the fastening means, in particular the screws, are not illustrated.

Figure 5:
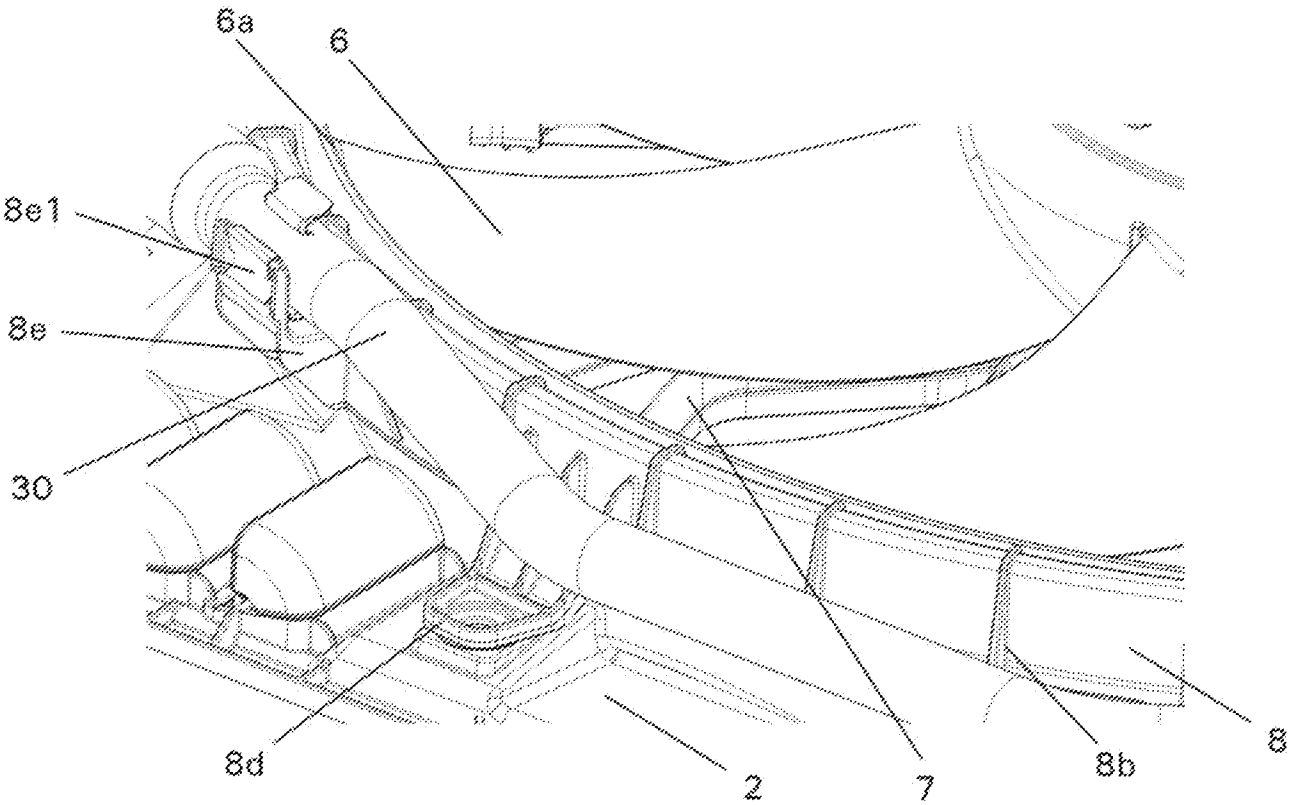
FIG. 5 a three-dimensional detail illustration of a cooling fan module according to an embodiment of the present invention.

FIG. 5 shows a three-dimensional detail illustration of a cooling fan module 10 according to an embodiment of the present invention.

In the embodiment illustrated in FIG. 5, the holding device 8 has a separate blocking element 8*e*1, which in particular has metal and which delimits the hose-like and/or tubular structure 30 in at least one degree of freedom, in particular by at least substantially completely surrounding the hose-like and/or tubular structure 30 in a cross-sectional direction aside from an insertion opening.

The embodiment illustrated in the figures is distinguished in particular by the fact that it combines at least one, in particular two, in particular all, of the following advantages:

stabilization of the fan shroud adaptation of the gap geometry; and provision of a holder for hose-like and/or tubular structures.

Thus, for the first time, a structure has been proposed, in the design of which at least one, in particular two, in particular all, of the above-stated characteristics can be individually adapted to the respective set of requirements. Here, depending on the embodiment, it is furthermore possible to realize yet further advantages with regard to simplified assembly of the fan wheel.

Although exemplary embodiments have been discussed in the description above, it is pointed out that numerous modifications are possible. In particular, such a design according to the invention of the fan shroud is also suitable for dissipating waste heat from components of a purely electrically operated vehicle. It is furthermore pointed out that the exemplary embodiments are merely examples which are in no way intended to restrict the scope of protection, the usages and the construction. Rather, the above description provides a person skilled in the art with a guide for implementing at least one exemplary embodiment, wherein various modifications, in particular with regard to the function and arrangement of the described constituent parts, may be made without departing from the scope of protection as defined by the claims and feature combinations equivalent thereto.

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

LIST OF REFERENCE DESIGNATIONS

2 Fan shroud
2*a* Shroud ring
2*a*1 Free end
3 Motor holder
4 Fan wheel recess
5 (Electric) motor
6 Fan wheel
6*a* (Fan wheel) outer ring
7 Strut
8 Ring-shaped structural element
8*a* U-shaped cross-sectional geometry
8*b* Stiffening means, in particular rib
8*c* Gap cross section reduction portion
8*d* Fastening means, in particular fastening flange
8*e* Holding device
8*e*1 Blocking element
10 Cooling fan module
20 Cooling
30 Hose-like and/or tubular structure, in particular hose
L Air flow direction
S Gap While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A cooling fan module comprising:

a fan shroud defining a fan wheel recess, wherein the fan wheel recess is delimited by a shroud ring;

a motor holder disposed in the fan wheel recess and mechanically connected to the fan shroud by struts;

a motor at least partially held in the motor holder;

a fan wheel disposed in the fan wheel recess and configured to be driven by rotation of the motor;

a separately formed, ring-shaped structural element arranged on the shroud ring; and a holding device extending from the ring-shaped structural element and configured to hold a hose and/or a tubular structure and/or delimits the hose-like and/or tubular structure in at least one degree of freedom.

2. The cooling fan module of claim 1, wherein the shroud ring has a cylindrical lateral surface, wherein a vector arranged normal to the cylindrical lateral surface is oriented at least substantially perpendicular to an axis of rotation of the fan wheel.

3. The cooling fan module of claim 1, wherein the shroud ring is formed as a single piece to the fan shroud.

4. The cooling fan module of claim 1, wherein the shroud ring extends in a downstream direction away from the fan shroud to a free end.

5. The cooling fan module of claim 4, wherein the ring-shaped structural element includes a U-shaped cross-sectional geometry in a radial cross section.

6. The cooling fan module of claim 5, wherein the free end of the shroud ring radially engages the ring-shaped structural element, and/or axially engages the ring-shaped structural element, and/or is at least partially received by the U-shaped cross-sectional geometry of the ring-shaped structural element.

7. The cooling fan module of claim 6, wherein the struts are arranged on an upstream side of the fan shroud.

8. The cooling fan module of claim 1, wherein the ring-shaped structural element includes a fastening flange configured to hold the ring-shaped structural element to the fan shroud.

9. The cooling fan module of claim 1, wherein the ring-shaped structural element includes stiffening means extending in a radial and/or axial direction, on a surface, opposite the shroud ring, of the ring-shaped structural element.

10. The cooling fan module of claim 1, wherein a gap is formed in a radial direction between the fan wheel and the shroud ring, wherein the ring-shaped structural element is at least partially disposed within the gap.

11. The cooling fan module of claim 1, wherein the ring-shaped structural element includes a gap cross section reduction portion formed as a single piece with the ring-shaped structural element and extending in a radial cross section towards the fan wheel wherein the gap cross section reduction portion is inclined at an angle $\alpha$ relative to an adjoining portion of the ring-shaped structural element, wherein the angle $\alpha$ ranges between 30° and 150°.

12. The cooling fan module of claim 11, wherein the angle $\alpha$ is at least 90°.

13. A cooling fan module comprising:

a fan shroud defining an opening including a periphery defined by a shroud ring, wherein the shroud ring has a partial U-shaped cross section including a first end and a second end;

a motor holder disposed in the opening;

a plurality of struts extending between the motor holder and a portion of the fan shroud;

a fan wheel disposed in the opening and configured to be driven by a motor received by the motor holder to rotate about a rotational axis, wherein the fan wheel includes an outer ring at least partially aligned with the first end in an axial direction, wherein the axial direction is parallel to the rotational axis; and a ring-shaped structural element having a U-shaped cross section defining an opening, wherein when the ring-shaped structural element is fixed to the fan shroud, the opening receives the second end of the shroud ring.

14. The cooling fan module of claim 13, wherein the portion of the fan shroud is formed by the second end of the shroud ring.

15. The cooling fan module of claim 14, further comprising a mounting flange extending from an outer periphery of the ring-shaped structural element and defining an aperture configured to receive a fastener to attach the ring-shaped structural element to the fan shroud.

16. The cooling fan module of claim 13, wherein the ring-shaped structural element includes an inner periphery formed by a gap cross section reduction portion, wherein the gap cross section reduction portion defines a radial plane along an angle $\alpha$, wherein the angle $\alpha$ ranges between 60° and 120°.

17. A cooling fan module comprising:

a fan shroud defining an opening including a periphery defined by a shroud ring;

a motor holder disposed in the opening;

a plurality of struts extending between the motor holder and a portion of the fan shroud;

a fan wheel disposed in the opening and configured to be driven by a motor received by the motor holder to rotate about a rotational axis; and a ring-shaped structural element including an inner surface and an outer surface, wherein the inner surface defines an opening that engages the fan shroud, and wherein the outer surface includes a holding device defining a recess configured to receive a hose.

18. The cooling fan module of claim 17, further comprising a blocking element disposed in the holding recess and configured to retain the hose.

19. The cooling fan module of claim 17, wherein the shroud ring includes a partial U-shaped cross section including a first end a second end, the ring-shaped structural element having a second U-shaped cross section and defining an opening, wherein the opening receives the second end of the shroud ring.

* * * * *